United States Patent [19]

Eary, Sr.

[11] Patent Number: 4,531,247

[45] **Date of Patent: * Jul. 30, 1985**

[54] ADJUSTABLE UPPER BODY REST

[76] Inventor: George D. Eary, Sr., 8 N. Woodlawn Ave., LaVale, Md. 21502

[ * ] Notice: The portion of the term of this patent subsequent to Jul. 19, 2000 has been disclaimed.

[21] Appl. No.: 425,375

[22] Filed: Sep. 28, 1982

[51] Int. Cl.[3] ..... A47G 9/00

[52] U.S. Cl. ..... 5/436; 5/434; 5/446

[58] Field of Search ..... 5/431, 434, 435, 436, 5/437, 440, 465, 433

[56] References Cited

U.S. PATENT DOCUMENTS

| | | | |
|---|---|---|---|
| 2,688,142 | 9/1954 | Jensen | 5/441 |
| 3,042,025 | 7/1962 | Jackson | 5/433 |
| 3,774,247 | 11/1973 | Bradley | 5/433 |
| 3,828,377 | 8/1974 | Fary, Sr. | 5/465 |
| 3,926,181 | 12/1975 | Eischen, Sr. | 5/436 |
| 4,221,213 | 9/1980 | Gregory et al. | 5/436 |
| 4,275,472 | 6/1981 | Erck | 5/436 |
| 4,346,488 | 8/1982 | Eary, Sr. | 5/436 |
| 4,455,698 | 6/1984 | Eary | 5/436 |

*Primary Examiner*—Gary L. Smith
*Assistant Examiner*—Vinh Luong

[57] ABSTRACT

An adjustable upper body rest is disclosed which is intended primarily for supporting the upper body while laying face down with the head turned to the right or left side at an angular position of approximately forty degrees below a horizontal plane. Likewise, supports at a higher elevation are provided for the head and an arm for the user who desires to lay on the right or left side. Said higher elevation is provided by moving both shoulder supports upward and toward the top of the "Adjustable Upper Body Rest".

A lower face support is provided which consists of one or more rests configured to be concave lengthwise and rotatable about a near horizontal axis. A forehead support is provided consisting of one or more rests configured as a "V" tilted toward the user. Said face and forehead rests provide open areas for the eyes, nose and mouth. Likewise, two similar shoulder supports are disclosed which are configured at their top sides to be convex at the end nearest to the head support and provide comfortable support for the shoulders while laying in the face down position. Said shoulder supports are each configured in a concave manner at their opposite ends and while positioned at a high or low elevation each provides a separate comfortable support for the user's head while laying on the right or left side.

The nose or mouth never contact any part of the body rest, precluding the deposit of germs therein, enabling rest in a sanitary manner.

7 Claims, 14 Drawing Figures

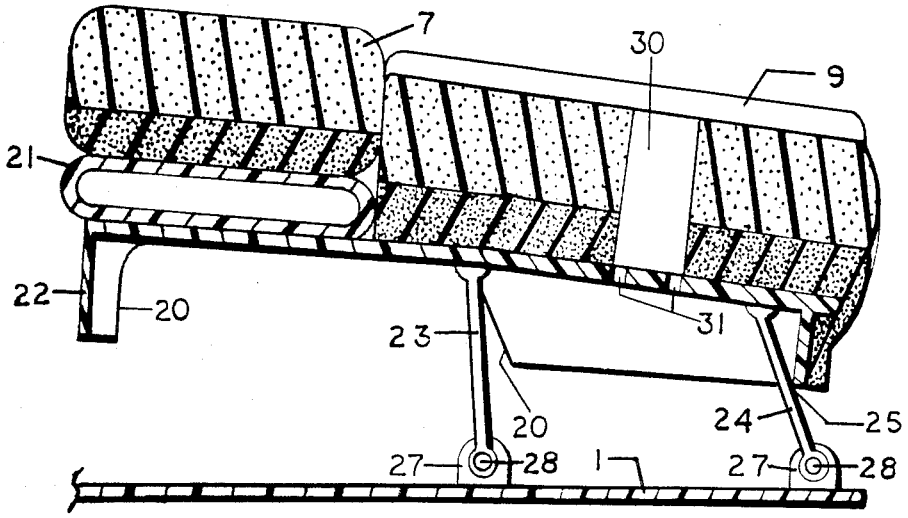
FIG. 11
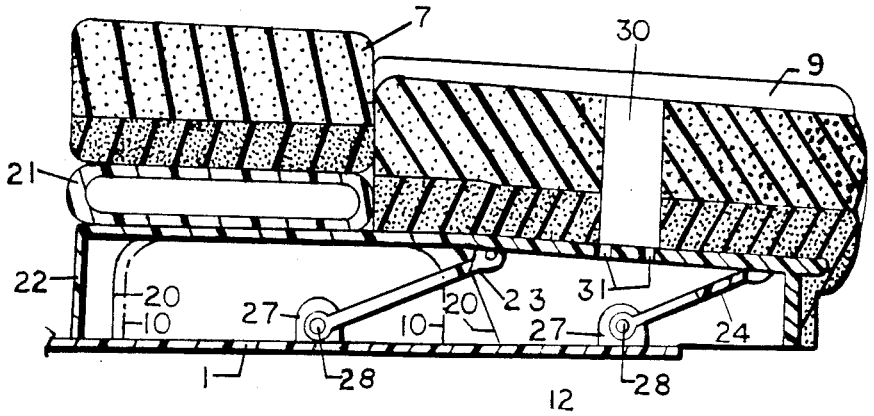
FIG. 12
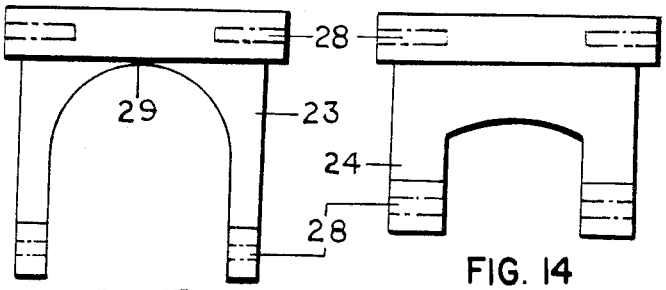
FIG. 13
FIG. 14

ADJUSTABLE UPPER BODY REST

BACKGROUND OF THE INVENTION

1. Field of the Invention

This invention relates to a support for the upper part of the body. More particularly it relates to a device which enables one to lie comfortably face-down with the head to the right or left side at an angular position of approximately forty degrees below a horizontal plane, wherein the head and shoulders are nested in a manner providing for a comfortable distribution of the upper body weight and which enables easy, unrestricted breathing in a sanitary manner through the nose or mouth. Moreover, it allows the user to lay on either the right side and shoulder or the left side and shoulder comfortably by providing two elevated rests, either one for the head and the other for the right or left arm. Either rest supports a portion of the body weight and all of the weight of the user's head at a proper elevation, thereby relieving most normal pressure on the shoulder joint while laying on either side. To change the upper body rest from a face-down mode of use to a right or left side mode of use, or to perform the reverse procedure of side use to face-down use, requires a minimum of effort allowing the user to remain undisturbed in the prone position while making either change.

2. Description of Prior Art

A number of devices have been patented which are stated to enable one to lie face-down or on the right or left side in comfort. While these devices are of assistance, they are not adjustable in as many modes as in the present device.

SUMMARY OF THE INVENTION

This invention consists of a base member having attached thereto a pair of spaced apart resilient shoulder rests which may be adjusted elevation wise to many different positions. Also a head rest is attached to a base member in a central position, toward the top or front, consisting of one or more sections for the lower face as well as one or more sections for the forehead, and is movable in any desired direction on a horizontal plane in a limited manner as well as being rotatable in a limited manner about different vertical axes.

BRIEF DESCRIPTION OF THE DRAWINGS

FIG. 11 is a sectional view along line I—I of FIG. 2.

FIG. 12 is a sectional view along line J—J of FIG. 1.

FIG. 13 is a plan view of shoulder rest 9 support member 23.

FIG. 14 is a plan view of shoulder rest 9 support member 24.

DESCRIPTION OF PREFERRED EMBODIMENTS

Figure 1:
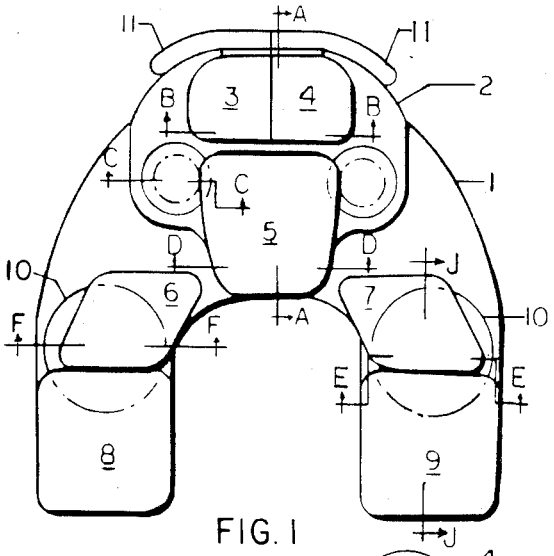
FIG. 1 is plan view of the adjustable upper body rest as used in the face-down repose.

FIG. 1 is a plan view and shows an adjustable upper body rest which has a base designated as 1 and is made of flat relatively thin, semi-rigid material to serve as a support for the head and shoulder rest support members to be adjustably attached thereon and thereto. Preferable material for all base, shoulder and head rest support members 1,2,12,13,19,21,22 and 33, etc. would be one or more of the various types of plastics. Alternately, any other light weight material could be used.

Figure 2:
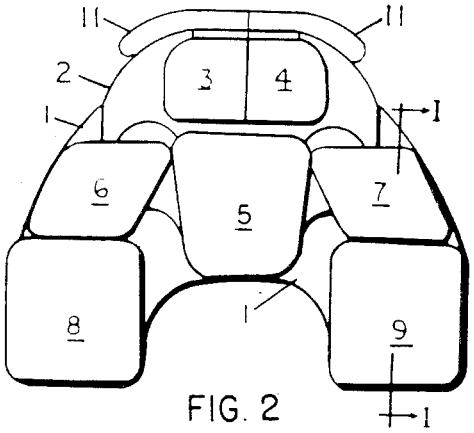
FIG. 2 is a plan view of the adjustable upper body rest as used for repose on the right or left side.

FIG. 2 is a plan view of the upper body rest showing the correct relative positions of all rests as positioned when the user desires to lay on the right or left side.

Figure 3:
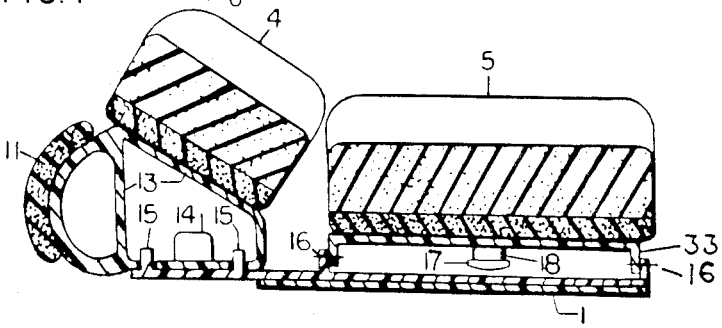
FIG. 3 is a sectional view along line A—A of FIG. 1.
Figure 6:
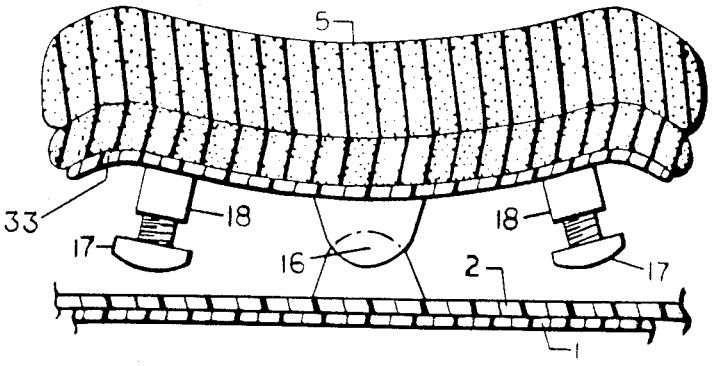
FIG. 6 is a sectional view along line D—D of FIG. 1.

FIG. 3 is a sectional view along line A—A of FIG. 1 and shows rests 4 and 5 as they are supported respectively by members 13 and 33. Also shown is member 11 which prevents any hard contact of the upper body rest with a bed headboard or the user's body. Forehead rest 4 is shown to be an intergal part of support 13, as rest 5 is shown to be an intergal part of support 33. Support 33 is shown to be attached to base 1 by pins, screws etc. and denoted by 16 and 16. Said attachment is also shown in FIG. 6 by number 16.

Figure 4:
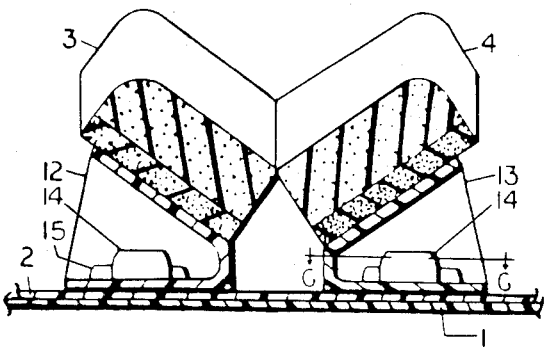
FIG. 4 is a sectional view along line B—B of FIG. 1.

FIG. 4 is a sectional view along line B—B of FIG. 1 and shows forehead rests 3 and 4 supported by plastic form members 12 and 13 respectively. Rests 3 and 4 form a modified "V" configuration. When the user's head is to the right, resting on member 4, the left temple is supported by rest 3. Likewise, when the user's head is to the left, rest 3 supports the forehead while rest 4 supports the right side of the user's head.

Figure 9:
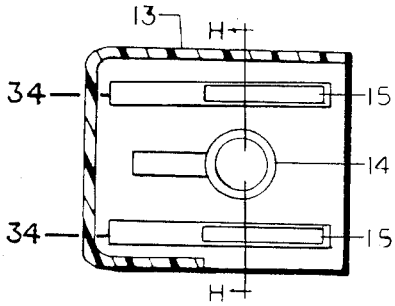
FIG. 9 is a sectional view along line G—G of FIG. 4.

Considering FIGS. 3, 4, 9 and 10 together, it is apparent how rests 3 and 4 are adjustably attached to base 2. Shown are extensions of base 2 protruding upward and identified by 15. Also shown in FIG. 9 are slots 34 and 34 which are slightly wider and somewhat longer. This configuration allows rests 3 and 4 to be moved closer together or farther apart. Knob, 14 can then be tightened to secure said rests in their proper positions. It is noted that lateral movement of rests 3 and 4 affect height alignment with rest 5 as well as lateral alignment. When rest 4 is moved to the right it is relatively lower with respect to rest 5 and allows the user's head to turn to a greater angle below the horizontal plane. Conversely, movement of rest 4 toward the left has the effect of raising it's height as related to lower face rest 5.

Figure 5:
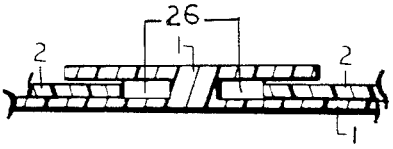
FIG. 5 is a sectional view along line C—C of FIG. 1.

FIG. 5 is a sectional view along line C—C of FIG. 1 showing portion of base 1 protruding upward and resembling a low toadstool with a a thin top that locks base 1 and base 2 together. Number 26 indicates open spaces resulting from a larger circular hole in base 2 and a relatively smaller hub protruding upward from base 1. Considering FIGS. 1 and 5 together, this configuration is typical two places near the wider end of lower face rest 5 and allows the head rest assembly to move in any direction on a horizontal plane and in a limited manner, as well as rotate in a limited manner about vertical axes, in relation to base 1.

FIG. 6 is a sectional view along line D—D of FIG. 1 showing lower face rest 5 and how said rest is rotatable about a horizontal axis in a limited manner about a point identified by number 16. It becomes obvious that the amount of rotation is controlled by stops 17 and 17. The farther stop 17 is threaded into member 18, the more rotation and the lower rest 5 will be, providing a greater angular dimension below a horizontal plane. FIG. 6 also shows rest 5 attached to base 2 as are all head rest members.

Figure 7:
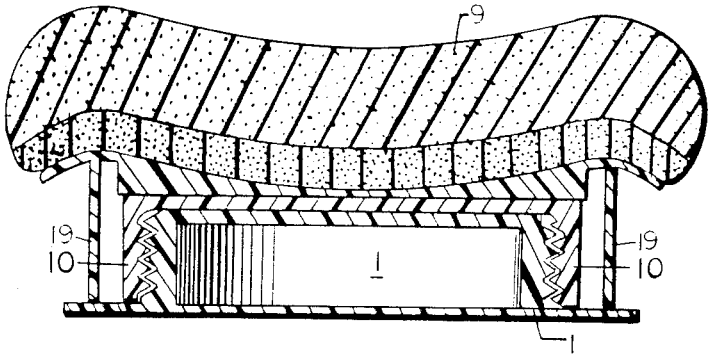
FIG. 7 is a sectional view along line E—E of FIG. 1.

FIG. 7 is a sectional view along line E—E of FIG. 1 and showing configuration provided to allow shoulder rests 8 and 9 to be adjusted higher and lower by turning member 10 in a rotational manner. Base 1 is shown to have a portion extending upward with course male threads around it's exterior which mate with the course interior threads of female member 10. Considering FIGS. 7 and 12 in conjunction it becomes apparent that sholder rests 8 and 9 are adjustably attached to base 1 by members 23 and 24 at base 1 extensions identified by the numbers 27 and of which there are four below each shoulder rest 8 and 9. Attaching means have been ommitted as sectional cut E—E doesn't cut through said members and also for reasons of clarity.

Figure 8:
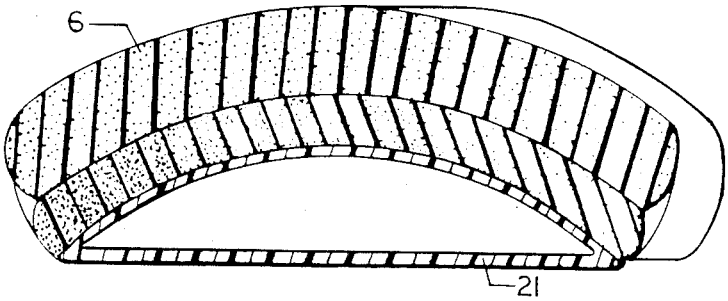
FIG. 8 is a sectional view along line F—F of FIG. 1.

FIG. 8 is a sectional view along line F—F of FIG. 1 showing the convex configuration of rest 6 with support 21. Considering FIGS. 8, 11 and 12 together, it becomes apparent that support 21 for rest 6 is positioned on top of a support similar to support 22, and a support for rest 7 is positioned on top support 22. It is hereby noted that the convex portions of the shoulder rests that are identified by the numbers 6 and 7 are intended for use only in the face-down position and those portions of the shoulder rest identified by the numbers 8 and 9 are intended for use when laying on the right or left side.

Figure 10:
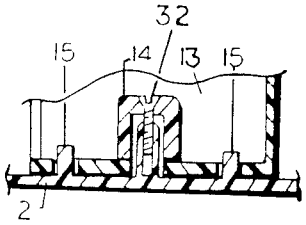
FIG. 10 is a sectional view along line H—H of FIG. 9.

FIGS. 9 and 10 show the attaching means to base 2 for the forehead rest 4 and it's support 13 in an adjustable manner and the means to stabilize the rest in the desired position. The same means are also used for attachment of rest 3 and support 12, and as described above.

FIG. 11 is a sectional view along line I—I of FIG. 2 showing the higher elevation position of shoulder rest 9 as intended for use when laying on the left or right side. Number 25 indicates the point of interference between supports 22 and 24 which supports the shoulder rest at the high elevation.

FIG. 12 is a sectional view along line J—J of FIG. 1 showing the shoulder rest at it's lowest possible position resting solidly on base 1. Shown by the number 10 two places are phantom lines indicating the approximate location of member 10 which can be rotated to lower or raise the complete shoulder rest. Considering FIGS. 11 and 12 together a cutout in the support 22 is provided as clearance for member 10 and is identified by the number 20 two places in each FIGS. 11 and 12. Also in each FIG. there is the number 30 to identify an opening in the resilient material as well as the number 31 to identify openings in support 22 to allow better hearing capabilities of a small radio or radio speaker which may alternately be adapted to fit underneath support 22.

FIGS. 13 and 14 are plan views of supports for the shoulder rests 8 and 9 when they are positioned at their highest elevations. It is herein noted that one member 23 and one member 24 are provided for each shoulder rest as shown in both FIGS. 11 and 12. The number 29 indicates a clearance for member 10 when the shoulder rests are at the lowest possible elevation. The number 28 indicates the points where pins or screws are used to attach members 1, 22, 23 and 24.

What is claimed:

1. An adjustable upper body rest for the head and shoulder portions of the human body in a predetermined position and comprising:

a. a base member, b. a pair of laterally spaced apart resilient shoulder support members adapted to support the shoulders of said human body in a predetermined position, c. each of said shoulder support members being so attached to the base to allow adjustments to a large variety of different elevations and with the capability of stabilization at any such elevation as may be desired, d. a forehead support member having separate movable members comprising at least one element supporting the forehead, configured as a "V+ tilted toward the user's face when the user is in a face down position, and providing support for the human forehead at varying degrees below a horizontal position to the right or left side, e. said forehead support members being movable closer to or farther from each other in a limited manner and providing means to align with the lower face member elevation-wise as well as in a linear manner, f. means provided to secure said forehead members in any desired position as well as to allow complete removeability from the base, g. a lower face rest, rotateable in a limited manner about a horizontal axis perpendicular to said forehead support members, h. means provided to adjust amount of rotation of the lower face rest about said horizontal axis, i. means provided to allow said lower face rest and said forehead support member, to be moved on a horizontal plane and simultaneously nearer to or farther from one or both of the said shoulder support members, in a limited manner, j. means provided to allow rotational movement of said lower face rest and said forehead support members about vertical axis in a limited manner, k. a lower face rest configured in a concave manner along an axis perpendicular to said forehead support members.

2. The device of claim 1 wherein at least one supporting surface normally in contact with the user's body is covered with cloth.

3. The device of claim 1 wherein exposed structural surfaces may be covered with a resilient material such as polyurethane to prevent any undesirable physical contact with the user or any nearby object.

4. The device of claim 3 wherein said polyurethane is covered with thin plastic.

5. The device of claim 1 wherein at least one supporting surface normally in contact with the user's head is covered with a material such as cloth and is pleasing to the touch.

6. Alternately, the device of claim 1 wherein at least one of the resilient support members has an elastic inflatable bladder core being adapted to be filled to various sizes thereof with fluids.

7. The device of claim 6 wherein said core is provided with a suitable cover of polyurethane and cloth.

* * * * *